US005224983A

United States Patent [19]

LaSalle et al.

[11] Patent Number: 5,224,983

[45] Date of Patent: * Jul. 6, 1993

[54] TOUGHNESS ENHANCEMENT OF POWDER METALLURGY ZIRCONIUM CONTAINING ALUMINUM-LITHIUM ALLOYS THROUGH DEGASSING

[75] Inventors: Jerry C. LaSalle, Montclair; Derek Raybould, Denville; Santosh K. Das, Randolph; Edward V. Limoncelli, Morristown, all of N.J.

[73] Assignee: Allied-Signal Inc., Morristownship, N.J.

[ * ] Notice: The portion of the term of this patent subsequent to Feb. 22, 2009 has been disclaimed.

[21] Appl. No.: 905,129

[22] Filed: Jun. 24, 1992

Related U.S. Application Data

[63] Continuation of Ser. No. 692,838, Apr. 29, 1991, abandoned.

[51] Int. Cl.[5] ..... C22F 1/02; C22F 1/047; C22F 1/057

[52] U.S. Cl. ..... 75/249; 75/10.64; 148/513; 148/514; 148/549; 148/703; 148/403; 148/439; 420/529; 420/533

[58] Field of Search ..... 75/249, 10.64; 148/439, 148/403, 549, 703, 513, 514; 420/529, 533

[56] References Cited

U.S. PATENT DOCUMENTS 4,661,172 4/1987 Skinner et al. ..... 148/439
4,816,087 3/1989 Cho ..... 148/439

OTHER PUBLICATIONS

N. J. Kim et al., "Microstructure & Mechanical Properties of Rapidly Solidified Al-Li-Cu-Mg-Zr Alloy Die Forging", Proc. Conf. Al-Li V, (1989) p. 123.
Quist et al., "Microstructure & Engineering Properties of Alloy 644 B", Proc. Conf. Al-Li V, (1989), p. 1695.
P. G. Partridge, "Oxidation of Aluminium-lithium alloys in the solid and liquid state", Int. Mat. Reviews, 1, (1990), p. 37.

*Primary Examiner*—R. Dean
*Assistant Examiner*—Sikyin Ip
*Attorney, Agent, or Firm*—Ernest D. Buff; Gerhard H. Fuchs

[57] ABSTRACT

A rapidly solidified zirconium containing aluminum lithium alloy powder consisting essentially of the formula $Al_{bal}Li_aCu_bMg_cZr_d$ where "a" ranges from 2.1 to 3.4 wt%, "b" ranges from about 0.5 to 2.0 wt%, "c" ranges from 0.2 to 2.0 wt% and "d" ranges from greater than about 0.6 to 1.8 wt%, the balance being aluminum. The powder is degassed in a vacuum at a temperature of at least about 450° C. Components consolidated from the powder exhibit high tensile strength and elongation together with excellent notched impact toughness.

6 Claims, 2 Drawing Sheets

TOUGHNESS ENHANCEMENT OF POWDER METALLURGY ZIRCONIUM CONTAINING ALUMINUM-LITHIUM ALLOYS THROUGH DEGASSING

This application is a continuation of application Ser. No. 692,838 filed Apr. 29, 1991, abandoned.

BACKGROUND OF THE INVENTION

1. Field of the Invention

This invention relates to rapidly solidified powder metallurgy aluminum-lithium-zirconium-X alloys, and, in particular, to a process for developing enhanced toughness through temperature control during powder degassing.

2. Description of Related Art

Aluminum-lithium alloys are increasingly important materials for lightweight high stiffness applications such as aerospace components. Rapidly solidified aluminum-lithium alloys having reduced density and improved mechanical properties are disclosed in copending U.S. patent application Ser. No. 478,306, filed Feb. 12, 1990. Those are defined by the formula $Al_{bal}Li_aCu_bMg_cZr_d$ wherein "a" ranges from about 2.1 to 3.4 wt%, "b" ranges from about 0.5 to 2.0 wt%, "c" ranges from about 0.2 to 2.0 wt% and "d" ranges from greater than about 0.6 to 1.8 wt%, the balance being aluminum. Forgings produced from these rapidly solidified aluminum lithium alloys have significantly improved mechanical properties compared with forgings produced using conventional ingot aluminum lithium alloys. The properties of forgings produced from a similar alloy but having somewhat lower zirconium have been reviewed by Kim, Raybould, Bye, and Das, Proc. Conf. Al-Li V, (1989), pg. 123 and by Quist, Bevers and Narayanan, Proc. Conf. Al-Li V, (1989), pg. 1695. In particular, Quist et al., who represent the perspective of the aerospace industry, have stated that further improvements in the strength-toughness combination are needed before these alloys can find widespread use in aerospace components.

Production of rapidly solidified aluminum lithium alloys can be divided into several steps. In the first step, the alloy is rapidly solidified by melt spinning into ribbon, which is thereafter pulverized into powder. The second step comprises degassing the powder and consolidation thereof into a bulk piece. In the third step, the consolidated article is extruded and/or forged into a useful shape. The fourth and final step comprises heat treating the alloy to optimizing the desired strength and ductility.

The present invention is directed to the degassing step of the process and provides a method whereby certain degassing parameters, especially the degassing temperature, is controlled to markedly improve the final toughness of the alloy. When carried out using alloys having appropriate zirconium levels, the process of the present invention produces Al-Li containing material having a significant strength-toughness improvement.

SUMMARY OF THE INVENTION

In accordance with the present invention, there is provided a process for producing enhanced toughness in consolidated articles made from the rapidly solidified zirconium containing aluminum lithium alloys. Surprisingly, it has been found that by controlling the conditions under which a powder comprised of these alloys is degassed prior to consolidation, the notched impact toughness of components produced by the process is increased by a factor of 1.5 to 2 times. While not being bound by any theory, the degassing treatment is believed to produce a more thorough removal of contaminants on the powder surface, leading to improved bonding of the powder particles. The surface contaminants subject to removal by the process of the present invention are produced by a variety of gaseous species typically present in the ambient atmosphere, including oxygen, hydrogen, moisture, carbon monoxide and carbon dioxide. A discussion of the surface contaminants on Al-Li alloys is set forth in P. G. Partridge, Int. Mat. Rev., 1, (1990), pg. 37. These gaseous species are adsorbed on the surface of the metal and may react with the aluminum, lithium, and/or magnesium present in the alloy to form surface compounds which prevent complete bonding of the powder during consolidation. When present as a film on the particles, these surface contaminants reduce toughness and ductility by preventing thorough metal-metal contact between the particles. The film thus prevents adequate bonding between the powder particles. Surface contaminants may also be present as discrete inclusions, which reduce mechanical properties by providing sites for void/crack nucleation during deformation. In accordance with the present invention, surface contamination is minimized by degassing the alloy powder under vacuum at a temperature in excess of 450° C.

Degassing is conventionally employed in processing of powder metallurgical systems. However, aluminum lithium alloys are unique as compared with other aluminum alloys and other metallic systems. Aluminum lithium alloys differ with other metallic systems because of the strong chemical affinity of lithium for chemical species such as oxygen, hydrogen, water and carbonates. When subjected to temperatures ranging between about 200° C. and 440° C., aluminum lithium alloys form a reactive compound known as the δ phase. The δ phase compound, described by the stoichiometric formula Al-Li, has a strong tendency to adsorb the aforementioned chemical species. Subjecting the zirconium containing Al-Li alloys to temperatures at or beyond 450° C. will dissolve the δ phase into the aluminum solid solution thereby liberating these adsorbed contaminants.

The addition of zirconium beyond the equilibrium solid solubility limit, made possible via rapid solidification, increases the strength-toughness combination. While not being bound by theory, this increase occurs since the added zirconium results in the formation of metastable $Al_3Zr$ precipitates having an $Ll_2$ crystal structure. These precipitates are isostructural with the A13Li (δ') precipitates which form the basis for strengthening most Al-Li alloys. However, the $Al_3Zr$ precipitates are more resistant to dislocation shear than $Al_3Li$. As a result, the presence of $Al_3Zr$ reduces planar slip during deformation and results in an overall improvement in the strength-toughness combination. The strength-toughness improvement is particularly enhanced for alloys in which the zirconium content is greater than 0.6 wt%, and most preferably ranges from about 0.8 wt% to about 1.0 wt%. Such preferred ranges of zirconium are particularly well suited to achieve the strength-toughness enhancement since they produce, upon rapid solidification, a sufficient amount of $Ll_2$ $Al_3Zr$ to prevent planar slip. Zirconium levels beyond 1.0% further homogenize slip, however, it becomes more difficult to suppress the formation of the equilibrium tetragonal $Al_3Zr$ phase at greater zirconium levels. This tetragonal phase is detrimental to toughness.

Use of high temperature degassing for contaminant removal at prior particle boundaries, together with optimized zirconium concentration to homogenize slip combine to produce an Al-Li alloy having an enhanced combination of strength and toughness.

Articles consolidated from the Al-Li alloy powder of the invention have ultimate tensile strength ranging from about 75 to 80 ksi, tensile elongation ranging from about 5 to 8% and T-L notched impact toughness ranging from about 100 to 150 in-lb/in$^2$.

BRIEF DESCRIPTION OF THE DRAWINGS

The invention will be more fully understood and further advantages will become apparent when reference is made to the following detailed description and the accompanying drawings, in which.

DESCRIPTION OF THE PREFERRED EMBODIMENTS

Figure 1:
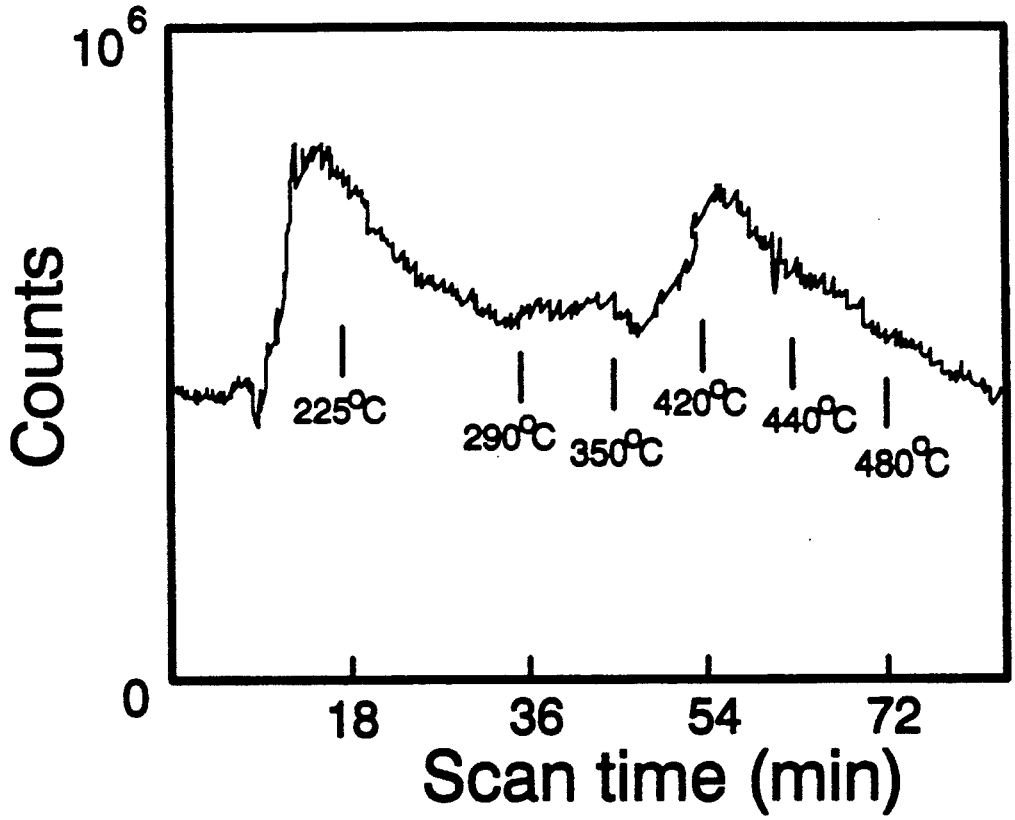
FIG. 1 is a mass spectrograph showing the evolution of gaseous species vs. temperature of Al-2.6Li-1.0Cu-0.5Mg-0.6Zr powder heated in a vacuum.
Figure 2:
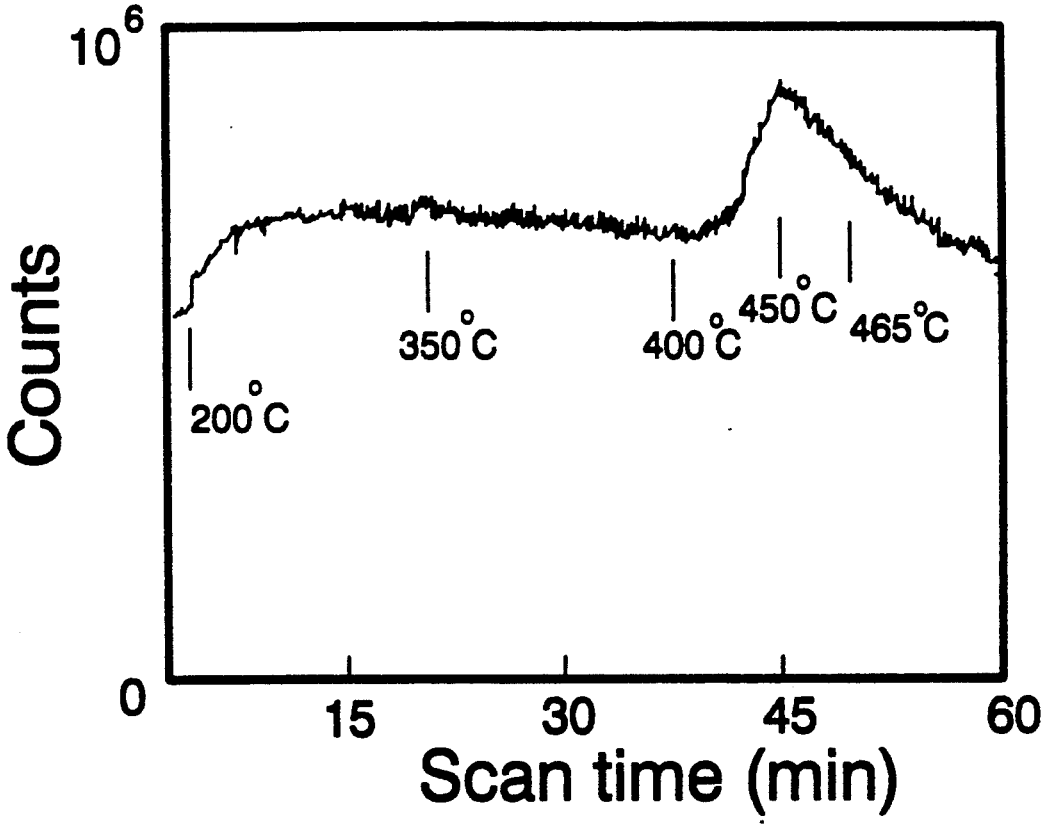
FIG. 2 is a mass spectrograph showing the evolution of gaseous species vs. temperature Al-2.6Li-1.0Cu-0.5Mg-0.6Zr powder heated in a vacuum after first being held in vacuum at 300° C for several hours.

Generally stated, the present invention provides a process for removal of contaminants adsorbed on the surface of a rapidly solidified zirconium containing aluminum lithium alloy powder consisting essentially of the formula $Al_{bal}Li_aCu_bMg_cZr_d$ wherein "a" ranges from about 2.1 to 3.4 wt%, "b" ranges from about 0.5 to 2.0 wt%, "c" ranges from about 0.2 to 2.0 wt%, and "d" ranges from greater than about 0.6 to 1.8 wt%, the balance being aluminum. Production of rapidly solidified aluminum lithium alloys described by the above formula can be divided into several steps. In the first step, the alloy is rapidly solidified by melt spinning into ribbon, which is then pulverized into powder. The second step comprises degassing the powder and consolidating it into a bulk piece. In the third step, the consolidated article is extruded or forged into a useful shape. The fourth and final step comprises subjecting the shaped article to a heat treatment to optimize the desired combination of strength and ductility. The present invention specifically addresses the degassing step which occurs prior to consolidation of the powder into a bulk component. Surface contaminants are removed via a process known as degassing in which the powder is heated in vacuum to drive volatile chemical species adsorbed on the surface of the powder. Subsequently, material is consolidated while still under vacuum by being subjected to a combination of high temperature and pressure. Degassing of the powder has been employed in connection with a variety of powder metallurgical alloys. Aluminum lithium powders, however, differ from conventional powders composed of aluminum and other metals in that the presence of lithium makes the powder significantly more reactive to contaminants which are Present in the ambient atmosphere such as oxyqen, moisture, CO, and $CO_2$. Moreover, at temperatures ranging from about 200° C. to 440° C., aluminum lithium alloys form a reactive compound known as the δ phase. Such a compound, consisting of the stoichiometric formula Al-Li, has a strong tendency to adsorb the aforementioned gaseous species. In accordance with the invention, it has been discovered that heating the powder to temperatures at or beyond 450° C., and preferably ranging from 450° C. to 480° C., will dissolve the δ phase into the aluminum solid solution, thereby liberating adsorbed contaminants bound to the δ phase. Removal of the contaminants, in turn, results in a tougher material since metal-metal contact between particles of the powder is enhanced, improving powder bonding during consolidation. In addition, thorough removal of contaminants reduces the inclusion content at the prior particle boundaries. This also toughens the material by reducing sites for void nucleation during deformation.

The following examples are presented to provide a more complete understanding of the invention, the specific techniques, conditions, materials, proportions and reported data set forth to illustrate the principles and practice of the invention are exemplary and should not be construed as limiting the scope of the invention.

EXAMPLE 1

Powder made from a rapidly solidified alloy having a composition of Al-2.6Li-1.0Cu-0.5Mg-0.6Zr was placed in vacuum in a mass spectrometer and heated at a constant rate to about 600° C. while the gas evolution was monitored as a function of temperature. Two peaks in the gas evolution are observed, one near approximately 200° C. and one near approximately 450° C. Beyond 450° C., the gas concentration drops to a constant background level. The analysis indicates that a temperature of approximately 450° C. is required for good removal of powder surface contaminants.

EXAMPLE 2

Powder made from a rapidly solidified alloy having a composition of Al-2.6Li-1.0Cu-0.5Mg-0.6Zr was placed in vacuum and held at a temperature of 300° C. for several hours, cooled to room temperature, and heated at a constant rate to about 600° C. while the gas evolution was monitored as a function of temperature. The disappearance of the first peak observed in Example 1 indicates that a thorough removal of contaminants volatile at 300° C. was obtained. The continued presence of the peak near 450° C. indicates that this temperature must be obtained for thorough removal of the surface contaminants and that extended periods of time spent at lower temperatures are not adequate to degas these components. Beyond 450° C., the gas concentration drops to a constant background level. The analysis indicates that a temperature of approximately 450° C is required for good removal of powder surface contaminants.

EXAMPLE 3

Consolidated pieces made from rapidly solidified Al-2.6Li-1.0Cu-0.5Mg-0.6Zr (wt%) powder degassed at either 200° C. or 480° C. were analyzed for impurities, listed in Table I.

TABLE I

| Degassing Temperature | Carbon (ppm) | Hydrogen (ppm) |
|---|---|---|
| 200° C. | 210 | 100 |
| 480° C. | 95 | 10 |

It is clear that the degassing treatment at 480° C. is more effective in reducing impurity elements than degassing at 200° C. Carbon has been reduced by a factor of two and hydrogen by a factor of ten.

EXAMPLE 4

Rectangular extrusions were made from rapidly solidified Al-2.6Li-1.0Cu-0.5Mg-0.6Zr (wt%) powder and Al-2.6Li-1.0Cu-0.5Mg-1.0Zr which was placed in a 10" diameter can and degassed at either 200° C. or 480° C. prior to being vacuum sealed within the can. Subsequently the cans were compacted, the can skin machined away, and the remaining billet extruded into 1"×4" rectangular slabs. The extrusions were next solutionized at 540° C. for 2 hrs., ice water quenched, and aged at 135° C. for 16 hrs. Tensile testing was done on transverse oriented cylindrical tensile specimens 0.188" in diameter and 0.75" gauge length using a strain rate of $5.5\times10^{-5}sec^{-1}$. Toughness was measured in an IZOD testing apparatus on transverse longitudinal oriented notched impact specimens having a 0.001"notch radius. The resulting data is listed in Table II.

TABLE II

| Composition | Degassing Temperature | YS (ksi) | UTS (ksi) | El (%) | N. Impact in-lb/in$^2$ |
|---|---|---|---|---|---|
| Al-2.6 Li-1.0 Cu-0.5 Mg-0.6 Zr | 200° C. | 64 | 70 | 3.3 | 55 |
| Al-2.6 Li-1.0 Cu-0.5 Mg-0.6 Zr | 480° C. | 63 | 75 | 5.3 | 100 |
| Al-2.6 Li-1.0 Cu-0.5 Mg-1.0 Zr | 480° C. | 69 | 78 | 5 | 100 |

*All samples from T/4 thickness position.

The Al-2.6Li-1.0Cu-0.5Mg-0.6Zr degassed at 480° C. has an ultimate tensile strength 5 ksi greater than the degassed at 200° C. Both tensile elongation and notched impact toughness double, increasing from 3.3 to 5.3% and 55 to 100 in-lb/in$^2$, respectively. This clearly illustrates the improvement in mechanical properties obtainable through employment of degassing temperatures beyond about 450° C. in material produced from degassed cans.

The Al-2.6Li-1.0Cu-0.5Mg-0.6Zr degassed at 480° C. has elongation and toughness substantially equivalent to the 0.6Zr alloy while having a 6 ksi improvement in yield strength. The overall strength-toughness combination is significantly greater for higher Zr containing alloys degassed at temperatures of about 480° C.

EXAMPLE 5

Rectangular extrusions were made from rapidly solidified Al-2.6Li-1.0Cu-0.5Mg-0.6Zr (wt%) powder which was degassed in-situ while vacuum hot pressing into 4.5" diameter billets which were subsequently extruded into ⅜"×21/4" rectangular slabs. Thermal treatment and mechanical property characterization were identical to that of Example 4. The resulting data is listed in Table III.

TABLE III

| Degassing Temperature | YS (ksi) | UTS (ksi) | El (%) | N. Impact in-lb/in$^2$ |
|---|---|---|---|---|
| 450° C. | 67.5 | 79.6 | 7.5 | 118 |
| 350° C. | 66.8 | 79.9 | 6.7 | 113 |
| 250° C. | 65.7 | 78.6 | 6.4 | 105 |
| 200° C. | 62.8 | 69.4 | 2.4 | 72 |

Both the tensile elongation and notched impact toughness increase continuously with increasing degassing temperature in a manner qualitatively similar to that of Example 4 indicating that mechanical properties are superior for vacuum hot pressed material degassed at high temperatures.

EXAMPLE 6

Rectangular extrusions were made from rapidly solidified Al-2.4Li-1.0Cu-0.5Mg-1.0Zr (wt%) powder which was degassed in situ and vacuum hot pressed into 4.5" diameter billets, which were subsequently extruded into ⅜"×21/4" rectangular slabs. Thermal treatment and mechanical property characterization were identical to that of Example 4. The resulting data is listed in Table IV.

TABLE IV

| Composition | Degassing Temperature | YS (ksi) | UTS (ksi) | El (%) | N. Impact in-lb/in$^2$ |
|---|---|---|---|---|---|
| Al-2.4 Li-1.0 Cu-0.5 Mg-1.0 Zr | 450° C. | 67.3 | 78.9 | 8.5 | 123 |
| Al-2.6 Li-1.0 Cu-0.5 Mg-0.6 Zr | 450° C. | 67.5 | 79.6 | 7.5 | 118 |
| Al-2.1 Li-1.0 Cu-0.5 Mg-0.6 Zr | 450° C. | 59.0 | 70.2 | 10.2 | 190 |

The tensile strengths are substantially the same for Al-2.6Li-1.0Cu-0.5Mg-0.6Zr and Al-2.4Li-1.0Cu-0.5Mg-1.0Zr, while the tensile elongation and notched impact toughness are slightly greater for the Al-2.4Li-1.0Cu-0.5Mg-1.0Zr alloy. The additional Zr has resulted in an overall higher strength toughness combination, despite the fact that the lower Li level of 2.4Li would be expected to have reduced the strength.

Having thus described the invention in rather full detail, it will be understood that such detail need not be strictly adhered to but that further chances may suggest themselves to one having ordinary skill in the art, all falling within the scope of the invention as defined by the subjoined claims.

We claim:

1. A process for developing enchanced toughness in a rapidly solidified zirconium containing aluminum lithium component, consisting of the steps of: subjecting a rapidly solidified zirconium containing aluminum lithium alloy to a high temperature degassing treatment, the alloys consisting essentially of the formula $Al_{bal}Li_aCu_bMg_cZr_d$ wherein "a" ranges from about 2.4 to 2.8 wt%, "b" ranges from about 0.5 to 2.0 wt%, "c" ranges from 0.2 to 2.0 wt%, "d" ranges form greater than about 0.8 to 1.0 wt% and the balance is aluminum and the degassing treatment being carried out at a temperature of at least about 450° C., said component having an ultimate tensile strength ranging from 75 to 80 ksi, a tensile elongation ranging from about 5 to 8% and a T-L notched impact toughness ranging from about 100 to 150 in-lb/in$^2$.

2. A process as recited by claim 1, wherein said component has a T-L notched impact toughness of at least about 110 in-lb/in$^2$.

3. A rapidly solidified zirconium containing aluminum lithium alloy powder consisting essentially of the formula $Al_{bal}Li_aCu_bMg_cZr_d$, where "a" ranges from about 2.4 to 2.8 wt%, "b" ranges from about 0.5 to 2.0 wt%, "c" ranges from 0.2 to 2.0 wt% and "d" ranges from greater than about 0.8 to 1.0 wt%, the balance being aluminum, said powder having been subjected to a degassing treatment carried out in a vacuum at a temperature of at least about 450° C.

4. A consolidated article produced from the rapidly solidified zirconium containing aluminum lithium alloy powder of claim 3, said article having a T-L notched impact toughness of at least about 110 in-lb/in$^2$.

5. In a method for producing a consolidated article from a rapidly solidified, zirconium containing aluminum lithium alloy powder, the improvement comprising the step of:

degassing said powder in a vacuum at a temperature of at least about 450° C., said powder consisting essentially of the formula $Al_{bal}Li_aCu_bMg_cZr_d$, where "a" ranges from about 2.4 to 2.8 wt%, "b" ranges from about 0.5 to 2.0 wt%, "c" ranges from 0.2 to 2.0 wt% and "d" ranges from greater than about 0.8 to 1.0 wt%, the balance being aluminum and said article having an ultimate tensile strength ranging from 75 to 80 ksi, a tensile elongation ranging from about 5 to 8% and a T-L notched impact toughness ranging from about 100 to 150 in-lb/in$^2$.

6. A method as recited by claim 5, wherein said degassing temperature ranges from about 450° C. to 480° C.

* * * * *